US006032576A

United States Patent [19]

Collins

[11] Patent Number: 6,032,576

[45] **Date of Patent: *Mar. 7, 2000**

[54] METHOD AND APPARATUS FOR SCREEN PRINTING ON A HARD SUBSTRATE

[75] Inventor: Terence William Collins, St. Helens, United Kingdom

[73] Assignee: Pilkington Automotive UK Limited, Merseyside, United Kingdom

[ * ] Notice: This patent issued on a continued prosecution application filed under 37 CFR 1.53(d), and is subject to the twenty year patent term provisions of 35 U.S.C. 154(a)(2).

[21] Appl. No.: 08/952,927

[22] PCT Filed: May 21, 1996

[86] PCT No.: PCT/GB96/01215

§ 371 Date: Jan. 27, 1998

§ 102(e) Date: Jan. 27, 1998

[87] PCT Pub. No.: WO96/40525

PCT Pub. Date: Dec. 19, 1996

[30] Foreign Application Priority Data

Jun. 7, 1995 [GB] United Kingdom ..... 9511468

[51] Int. Cl.[7] ..... B05C 17/06

[52] U.S. Cl. ..... 101/127; 101/129

[58] Field of Search ..... 101/127, 128.21, 101/129

[56] References Cited

U.S. PATENT DOCUMENTS

| | | | |
|---|---|---|---|
| 202,487 | 12/1878 | Ballard | 101/127 |
| 740,961 | 10/1903 | Wilcox | 101/127 |
| 3,746,540 | 7/1973 | Rarey | 101/DIG. 37 |
| 3,851,581 | 12/1974 | Baum et al. | 101/129 |
| 4,246,866 | 1/1981 | Hopings et al. | 101/126 |
| 4,268,545 | 5/1981 | Hodulik | 101/127 |
| 4,958,560 | 9/1990 | Collins | 101/129 |
| 5,250,321 | 10/1993 | Andersson et al. | 101/126 |
| 5,390,595 | 2/1995 | Cutcher | 101/129 |
| 5,485,781 | 1/1996 | Rovaris | 101/129 |
| 5,678,481 | 10/1997 | Matsumoto et al. | 101/129 |
| 5,778,793 | 6/1998 | Mello et al. | 101/DIG. 40 |

FOREIGN PATENT DOCUMENTS

| | | |
|---|---|---|
| 281 351 | 9/1988 | European Pat. Off. . |
| 507 643 | 10/1992 | European Pat. Off. . |
| 688 669 | 12/1995 | European Pat. Off. . |
| 82049 | 7/1895 | Germany . |
| 43 11 002 | 6/1994 | Germany . |
| 2 050 104 | 12/1980 | United Kingdom . |
| 2 075 214 | 11/1981 | United Kingdom . |

OTHER PUBLICATIONS

Translated claims for EP 507643, Oct. 1992.

*Primary Examiner*—John Hilten
*Assistant Examiner*—Daniel J. Colilla
*Attorney, Agent, or Firm*—Burns, Doane, Swecker & Mathis, L.L.P.

[57] ABSTRACT

A method of screen printing on to a hard non-absorbent substrate (1) involves using a screen (10) which has an ink permeable area (B) whose pattern corresponds to whatever is to be printed. The area B is divided into two parts (X and Y). Part X is of normal, maximum, ink carrying capacity and part Y is of reduced ink carrying capacity. The ink carrying capacity of the reduced ink carrying capacity part Yis determined by the extent to which it is coated with ink/impenetrable emulsion (20), the size of the pores (18) in the screen (10) and the type of ink used. The ink carrying capacity of the part Y reduces with distance away from part X. The emulsion coating (20) may be in the form of dots (200), with the dots (200) increasing in diameter with distance away from part X. During printing, the reduced ink carrying capacity part Y is located over the edge region (E) of the substrate (1), and the substrate is printed up to but not on to its edge (6).

16 Claims, 4 Drawing Sheets

METHOD AND APPARATUS FOR SCREEN PRINTING ON A HARD SUBSTRATE

TECHNICAL FIELD

The invention relates to printing and in particular to a method of screen printing on to a hard non-absorbent substrate such as glass. The invention also relates to a hard non-absorbent screen printed substrate and to a screen for use in printing on to such a substrate.

BACKGROUND ART

Vehicle windows are commonly printed around their peripheral margins with so-called obscuration bands. These are opaque, usually black, and may cover the rough vehicle body parts, wires etc which underlie the peripheral margin of the window, or may help to protect the adhesive bonding the window to the vehicle body from UV degradation.

The printing on to a vehicle window is normally done using a silk screen process. The screens are prepared to be selectively permeable to ink. Some areas of the screen are blocked out and other areas are left open. The open, ink permeable areas correspond to the patterns, for example, the obscuration band, which are to be printed on the glass.

The preparation of a printing screen involves stretching woven fabric, for instance, polyester, tightly across a frame, often of aluminium. The blocking may be done using a photographic technique. In one such technique, the screen is coated with photosensitive emulsion either by hand or by machine. After this, artwork is fixed, say by vacuum holding means, against the screen. The artwork may be in the form of a transparency, prepared and printed using, for example, CAD. The transparency has masked out, opaque areas which match the desired printed pattern Consequently, when the screen is subsequently exposed to light, the masked out areas prevent any light getting through to the emulsion underneath. This unexposed emulsion remains soft and can be washed away with warm water jets leaving the fabric therebelow open and permeable to ink. The exposed emulsion hardens so as to render the fabric it coats impermeable. The screen therefore ends up impermeable everywhere except in the areas which correspond to the desired printed pattern.

The printing of a window obscuration band is commonly carried out as part of the window production process, prior to bending and toughening or laminating. In the printing machine, the screen is suspended horizontally above the glass. The machine has a flood coater and a squeegee, each of which makes a pass across the screen. On a first pass, the flood coater coats the screen with ink. On the next pass, the squeegee forces the screen to make a line contact with the glass. Where contact is made by an open screen area, the ink carried therein is transferred on to the glass below. Initially, the ink is transferred in the form of discrete pillars, each pillar corresponding to the blob of ink carried in a particular pore in the screen mesh. In time, the discrete pillars spread and fuse into their adjacent neighbours to form a continuous coating of ink. The coating is then cured or dried.

There is an increasing tendency for vehicle designers to specify more exposed edges to their vehicle windows, and this in turn places demands on the window manufacture to be able to print close to the window edge. There are, however, a number of difficulties associated with printing to the edge. For example, mis-registration of the printing screen and the glass, or variations in the size of the glass, can result in ink being transferred from the screen on to the edge of the glass or the ink may spread over the edge. This is undesirable, both for aesthetic reasons and because the excess ink can result in the glass being weakened on toughening. One way of avoiding this has been to aim to print the band slightly short of the edge. However, this is not an altogether satisfactory method because it can in certain circumstances result in there being a noticeable gap between the band edge and the glass edge.

Other methods of printing to the edge have been proposed but they generally tend to involve complex, specialist apparatus and increased processing times. For instance, in EP 507 643 it is proposed to place an extension piece around the glass, to print the glass beyond its edge and on to the extension piece and then to remove the extension piece once the ink has dried. What is required is a solution to the problem of printing to the edge which does not involve complex or lengthy processing.

THE INVENTION

The invention provides a method of screen printing on to a hard non-absorbent substrate using a screen having at least one area which is permeable to ink, wherein the screen is located over the substrate during printing with an ink permeable area extending beyond an edge of the substrate, characterised in that a part of said ink permeable area which contacts the region of the substrate adjacent said edge during printing has a reduced ink carrying capacity.

The method according to the invention enables substrates to be printed right up to but not on to their edges using standard printing apparats and without increased processing times. Ink is only transferred from ink permeable areas which contact the substrate sure. As the part of the screen which contacts the region of the substrate adjacent the edge has only a reduced ink carrying capacity, only a limited quantity of ink is transferred on to that region: this quantity is carefully calculated so that although there is sufficient to form a continuous coating, there is insufficient to spread on to the edge of the substrate.

In addition to enabling printing specifically up to the edge of a substrate, the method according to the invention also allows for a degree of mis-registration of the screen and the substrate. Having a reduced ink carrying capacity part in the screen means that there can be an increase in the tolerance with which the screen is located over the substrate and to variations in the size of the substrate. As long as the edge up to which the printing is to take place lies somewhere under a reduced ink carrying capacity part, printing will always be up to but not beyond the edge. Again, this is achieved by appropriately calculating the ink carrying capacity across the reduced ink carrying capacity part. Consequently, mis-registration distances up to the width of a reduced ink carrying capacity part are possible whilst still providing a print up to the edge. This proves a particularly useful feature when printing around holes in the substrate, for example, when the substrate is a vehicle side window, holes are often provided to take body fastenings and these holes are often surrounded by a printed area which has to extend right up to the edge of the hole.

In a preferred embodiment, the ink carrying capacity varies across the reduced ink crying capacity part.

Further preferably, the ink carrying capacity of the reduced ink carrying capacity part decreases with distance away from the remainder of the ink permeable area of the screen.

Also preferably, the ink carrying capacity of the reduced ink carrying capacity part is determined by the extent to which the screen in that part is coated with emulsion. The reduced ink carrying capacity part may be coated with dots of emulsion and to achieve a variation in the carrying capacity across this part the dots may increase in diameter with distance away from the remainder of the ink permeable area of the screen. The ink carrying capacity of the reduced ink carrying capacity part may also be determined by the type of screen mesh and/or the type of ink.

The invention further provides a hard non-absorbent substrate which has been printed using a method described above.

The invention also provides a screen for use in a method described above.

The invention additionally provides a screen for use in printing on to a hard non-absorbent substrate comprising at least one area which is permeable to ink, wherein an ink permeable area extends beyond an edge of the substrate when the screen is located over the substrate during printing, characterised in that a part of said ink permeable area has a reduced ink carrying capacity, said part contacting the region of the substrate adjacent said edge during printing.

THE DRAWINGS

FIG. 1 a plan view of a vehicle window which has been printed using a method according to the invention;

BEST MODE

Figure 1:
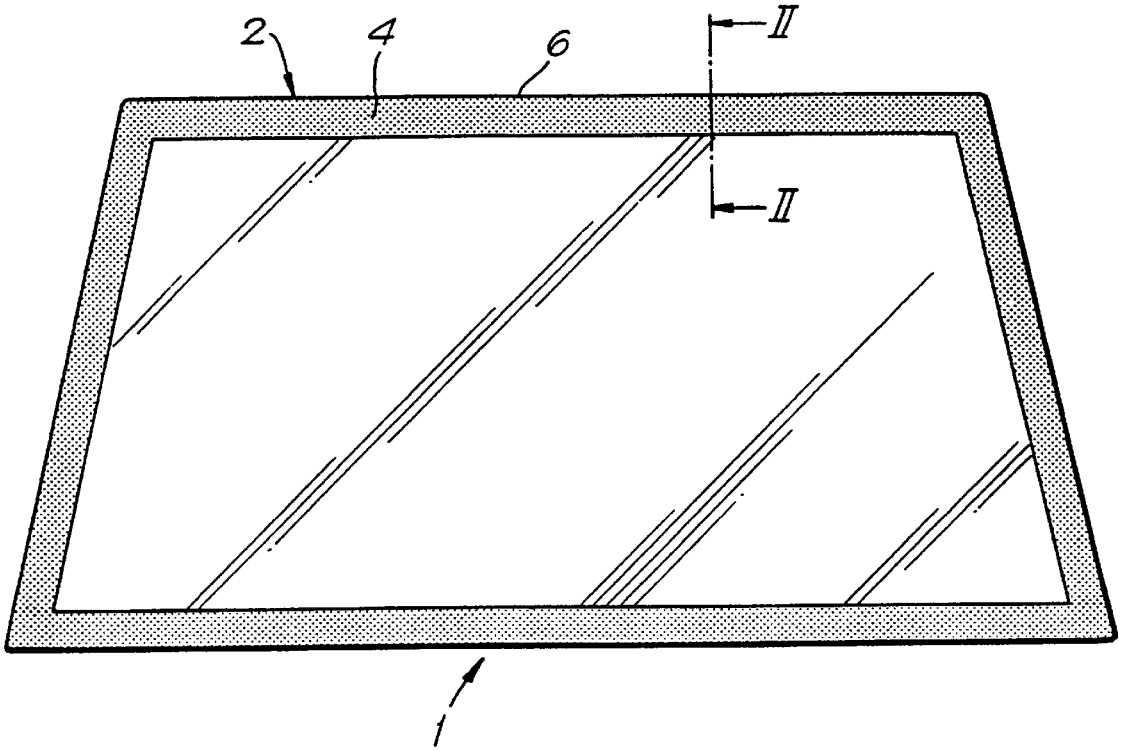

FIG. 1 illustrates a vehicle front window indicated generally at 1 which has been printed using a method according to the invention with a black obscuration band 4 around its peripheral margin 2. The band 4 is 40 mm wide, extends completely across the margin 2 and right up to but not on to the peripheral edge 6 of the window 1.

Figure 2:
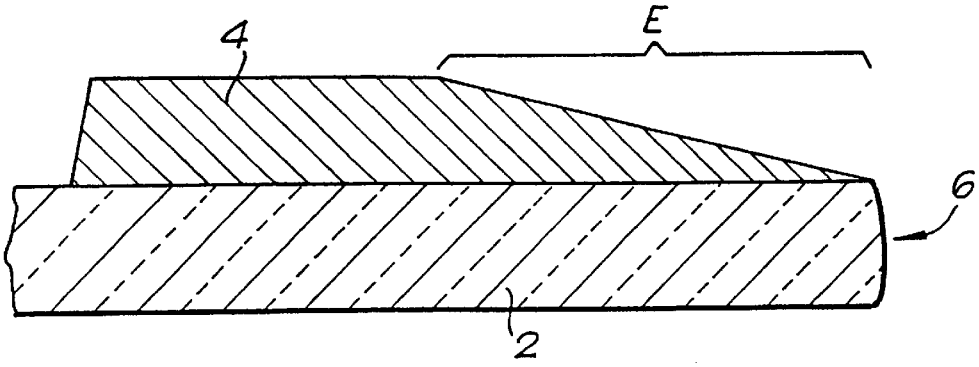
FIG. 2 is a cross-sectional view taken along the line II—II through the peripheral margin of the window shown in FIG. 1.

FIG. 2 shows the peripheral margin 2 of the window 1 in cross-section. The obscuration band 4 varies in thickness in the transverse direction. The band 4 is of generally uniform thickness further away from the edge 6 but over the region E adjacent the edge 6 the band 4 becomes gradually thinner, deceasing in thickness towards the edge 6. This edge region E is only of the order of 3–5 mm wide (largely exaggerated for clarity in the figures) so any difference in the colour density as a result of the reduced thickness at the band edge is imperceptible to the naked eye. The variation in thickness may be achieved by altering the structure of a conventional printing screen as will be explained hereinafter.

As described above, a conventional printing screen may have distinctly differentiated areas: those permeable to ink and those impermeable to ink or, put another way, those having an ink carrying capacity of a particular, uniform value and those having no ink carrying capacity. However, in the screens for use according to the invention the permeable area of the screen is further sub-divided into two parts: one part having a maximum ink carrying capacity and the other having a reduced ink carrying capacity. The ink carrying capacity is determined by the extent to which, that is, what proportion of the area of, the particular part is coated with emulsion, the choice of mesh, that is, how fine a mesh is used, and the choice of ink; inks vary in density and viscosity. Thus, by controlling the combination of the number of pores in any part which are blocked with emulsion, the size of the pores that are left open, which is dependent upon the fineness of the mesh used and/or any partial blocking by emulsion, and/or the type of ink that is carried by those pores, it is possible to alter the ink carrying capacity of that part.

Figure 3:
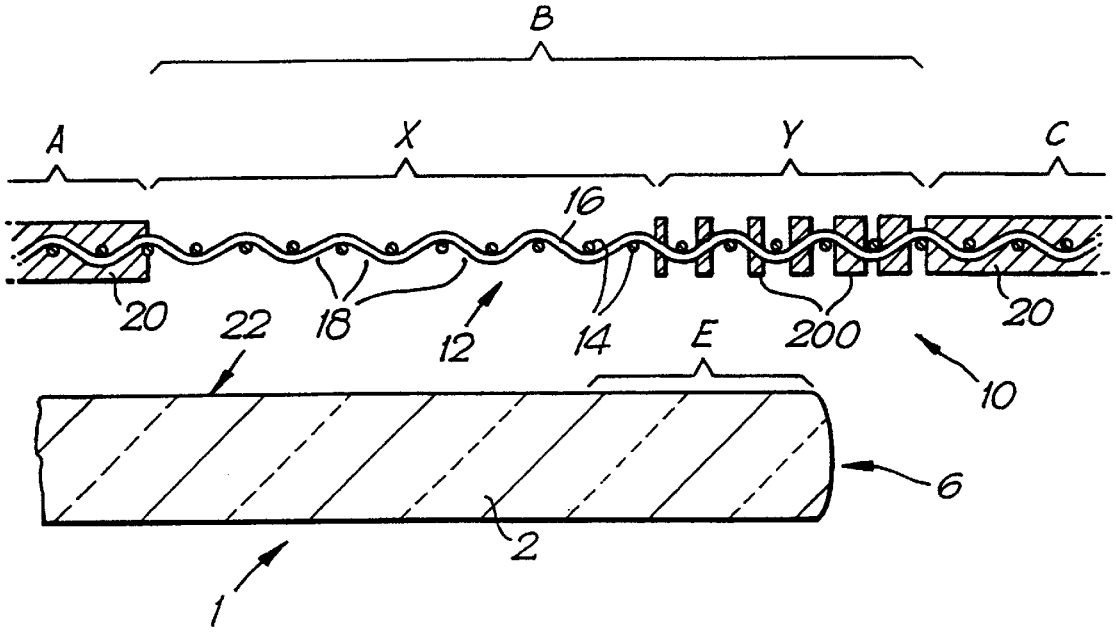
FIG. 3 is a schematic partial cross-sectional view of a printing screen for use in a method according to the invention, shown in its pre-printing position in relation to a vehicle window to be printed as illustrated in FIG. 1.

FIG. 3 illustrates a porous printing screen 10 for use in a method according to the invention, for printing an obscuration band around the peripheral margin of a vehicle window 1. The screen 10 has a polyester mesh 12 made up of interwoven weft and warp threads 14,16 which define pores 18 therebetween. The screen 10 is divided into three areas: areas A and C where it has zero ink carrying capacity and is impermeable to ink and area B where it is permeable to ink. Area B, whose pattern corresponds to that of the band to be printed, is further subdivided transversely into two parts: part X which has maximum ink carrying capacity and part Y which has reduced ink carrying capacity. The ink carrying capacity of any area or part is dependent partly on the size of the pores 18 and the extent to which the pores 18 in that part/area are blocked with emulsion. In impermeable areas A and C, all of the pores 18 are blocked by a coating of emulsion 20 and no ink can penetrate the mesh 12. In permeable part X, all of the pores 18 are unblocked and open and can carry ink. In the reduced carrying capacity part Y, some of the pores 18 are blocked, some are open and some are partially blocked. Hence, in part Y, the only pores 18 which can carry ink are those which are open or only partially open (partially blocked). The overall effect, therefore, is that part Y is not able to carry as much ink per unit area as part X. Furthermore, the ink carrying capacity of part Y is graduated in the transverse direction, being greater nearer part X than area C so as to effectively provide a smooth transition from the maximum ink carry capacity part X to the zero carrying capacity part C. This is achieved by varying the extent of emulsion coating across part Y: near to part C, the degree of emulsion 20 coating is such that a large proportion of the pores 18 are blocked and rendered impenetrable to ink whereas the proportion of blocked pores 18 is gradually decreased towards area X.

The emulsion coating 20 over the reduced carrying capacity part Y is not continuous, but in the form of a matrix of dots 200, that is, discrete columns of emulsion which are substantially round when viewed from above the surface of the screen 10, with each dot 200 blocking one or more pores 18. The dots 200 are equally spaced, in the sense of the distance between their centres, but they vary in size across part Y: nearest part C the dots 200 are relatively large in diameter (to the extent that very close to part C they merge to form a continuous coating) so as to block a large proportion of the pores 18. Nearer part X, the dots are smaller and block fewer pores 18. Hence, the dots of emulsion result in part Y having a reduced ink carrying capacity which increases in the transverse direction from part C to part X.

FIG. 3 illustrates (again, in exaggerated dimensions for clarity) the relative positioning of the screen 10 in relation to a window I during the printing of a peripheral obscuration band 4 as shown in FIG. 1. The band 4 is printed by transferring ink from the required pattern area B on to the window 1. Prior to printing, the screen 10 is suspended over the window 1 and registered such that the reduced ink carrying capacity part Y is above the edge region E and extends beyond the edge 6. As explained hereinbefore, the application of ink involves flood coating the open and partially open pores 18 of the mesh 12, and then, using a squeegee (not shown) forcing the mesh 12 to make a line contact with the top surface 22 of the window 1. Where contact is made with a part of the mesh 12 carrying ink, the ink will be transferred, and the transfer occurs by each pore 18 depositing the blob of ink it is carrying on to the window surface 22. Ink is retained in an open part of the mesh 12 which does not make contact with the window surface 22 such as the section of the part Y which extends beyond the edge 6.

Figure 4:
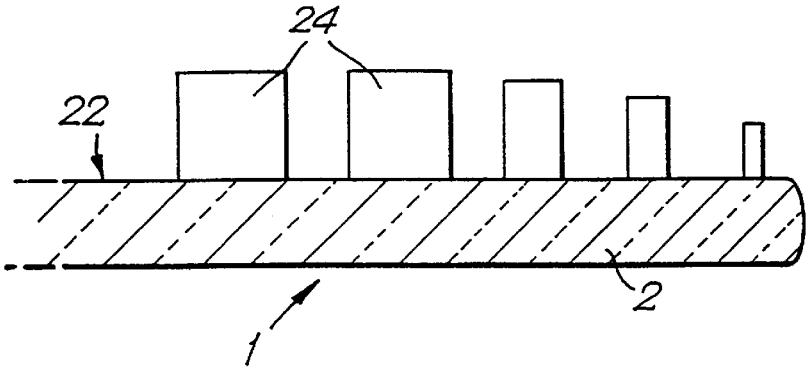
FIG. 4 is a schematic cross-sectional view of the vehicle window of FIG. 1, shown during the printing process after the ink has been initially transfer from the printing screen to the surface of the window.
Figure 5:
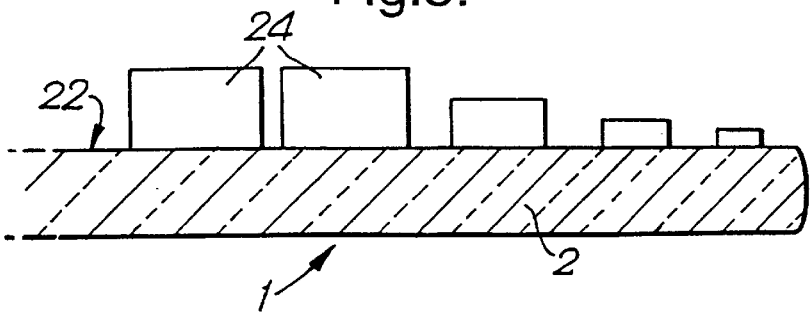
FIG. 5 is schematic partial cross-sectional view similar to that shown in FIG. 4, but some time later in the process.

Initially, the transferred ink blobs 24 sit as discrete pillars on the window surface 22 (FIG. 4). Subsequently, the blobs 24 spread and fuse (FIG. 5) into their near neighbours to form a continuous coating of ink. All the pores 18 of part X can carry ink, so the blobs 24 transferred from part X and the pillars they form tend to be of similar size and generally uniform spacing. On the other hand, part Y, because of its reduced carrying capacity, has fewer blobs 24 to transfer and those that are transferred are more widely spaced, the spacing increasing towards area C. This results in the ink pillars transferred from part Y spreading and fusing to form a coating of non-uniform thickness, the coating being thinner towards the window edge 6 where each of the pillars has had to spread further to fuse with its near neighbour (FIG. 2). Hence, a continuous coating is formed across the peripheral margin 2 of the window 1 (the obscuration band 4). However, contacting only the reduced ink carrying capacity part Y of the screen 10 with the edge region E means that, in comparison to the remainder of the printed peripheral margin 2, a reduced quantity of ink is transferred to the edge region E. The reduced ink carrying capacity of part Y is calculated such that whilst sufficient ink is transferred on to edge region E to form a continuous coating right up to the edge 6, insufficient ink is transferred to result in any spreading on to the edge 6.

Figure 6:
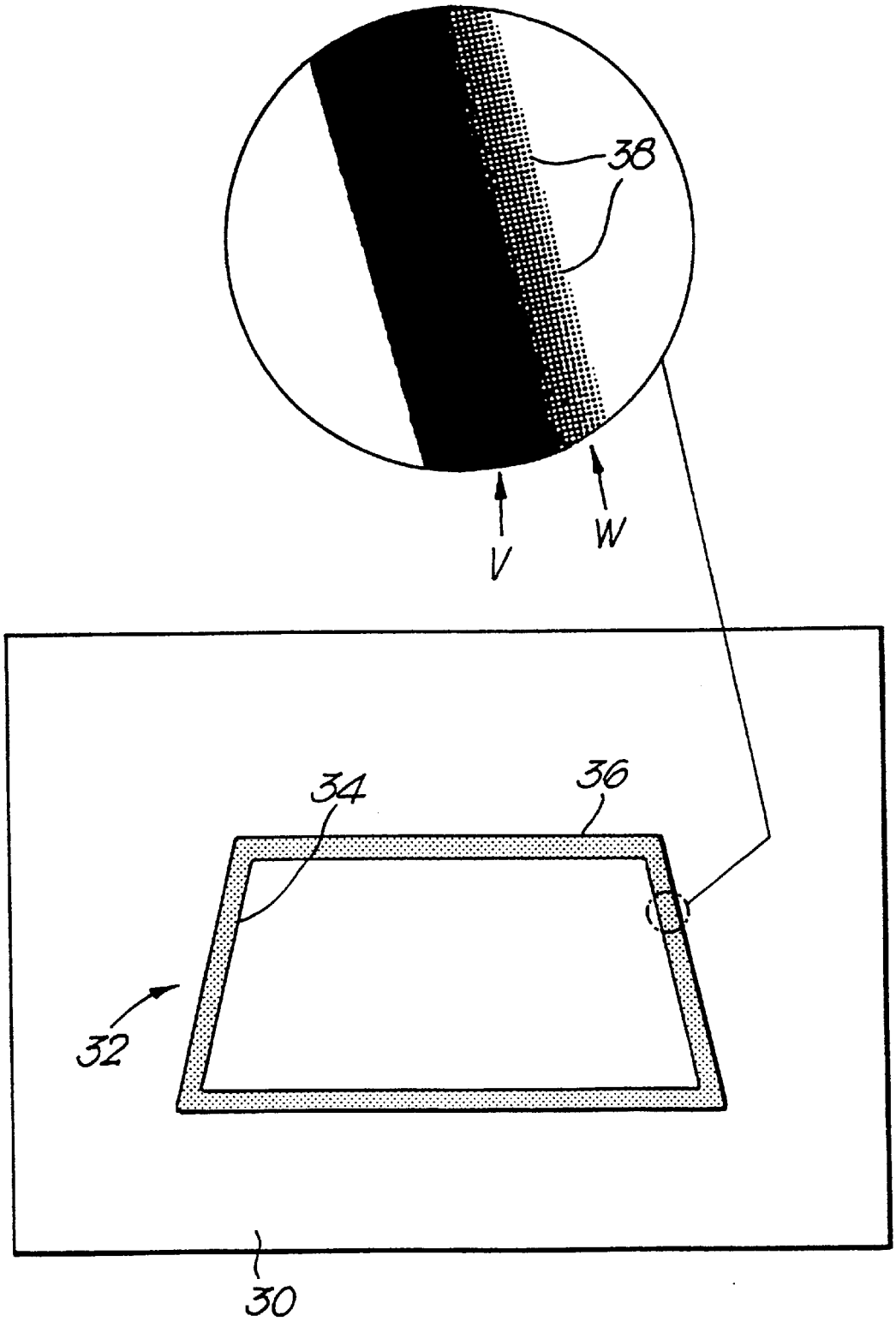
FIG. 6 is a plan view, including an exploded portion of the dot pattern, of artwork used in producing screen of the type shown in FIG. 3.

FIG. 6 illustrates artwork used for preparing the screen described with reference to FIG. 3 The artwork is in the form of a transparent, plastics material sheet 30 which carries a mask 32 corresponding to the pattern to be printed, in this case a vehicle window pane peripheral obscuration band. The masking out is done by preparing the desired pattern on a CAD or other system (not shown) and then by printing this pattern 32 on to the sheet 30.

The pattern 32, like the permeable area of the screen 10, is divided into two parts: Part V, which is the part all around and adjacent the inner periphery 34 of the pattern 32, is solidly masked whereas part W, which is the part all around and adjacent the outer periphery 36 of the pattern 32, is only partially masked. Where there is solid masking, the artwork is totally impenetrable to light. The partially masked part W consists of a matrix of printed round dots 38. The light permeability across the part W varies according to the size of dots 38. The dots 38 are each evenly spaced (spacing between their centres) but the dots 38 nearest the inner periphery 34 are larger in diameter than those nearest the outer periphery 36. Thus, the light permeability across the partially masked part W increases transversely, towards the outer periphery 36. Consequently, when the artwork is placed against an emulsion coated screen and exposed to light, the solid masked part V protects the emulsion underlying it from exposure, which produces a screen part of maximum ink carrying capacity, and the partially masked part allows light through only to the emulsion which does not underlie a printed dot, which produces a screen part of reduced ink carrying capacity, the ink capacity varying according to the size of the dots.

Figure 7:
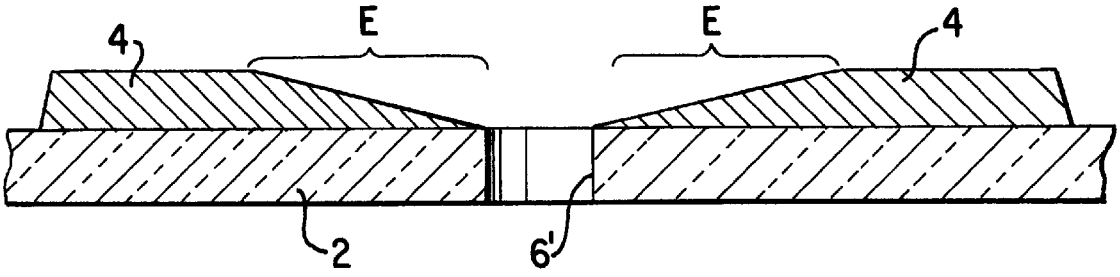
FIG. 7 is a partial cross-sectional view similar to FIG. 2 but taken through a hole in the window.

The present invention also has application to printing around holes 6' in a substrate 2, for example a vehicle window, as illustrated in FIG. 7.

I claim:

1. A method of screen printing on to a hard non-absorbent substrate using a screen having at least one ink permeable area which is permeable to ink, said ink permeable area having a first part and a second part, the method comprising locating the screen over the substrate with the ink permeable area extending beyond an edge of a hole the substrate, applying ink to the screen, and printing the ink onto the substrate, with the first part of said ink permeable area of said screen which contacts a region of the substrate adjacent said edge of said hole during printing having a reduced ink carrying capacity relative to the second part of said ink permeable area.

2. A method according to claim 1 wherein the step of locating the screen over the substrate involves locating over the substrate a screen having an ink carrying capacity that varies across the first part.

3. A method according to claim 2 wherein the step of locating the screen over the substrate involves locating over the substrate a screen in which the ink carrying capacity of the first part decreases with distance away from a remainder of the ink permeable area of the screen.

4. A method according to claim 1 wherein the step of locating the screen over the substrate involves locating over the substrate a screen in which the ink carrying capacity of the first part is determined by the extent to which the screen in that part is coated with an emulsion.

5. A method according to claim 4 wherein the step of locating the screen over the substrate involves locating over the substrate a screen in which the first part is coated with dots of emulsion.

6. A method according to claim 1 wherein the step of locating the screen over the substrate involves locating over the substrate a screen in which the reduced ink carrying capacity part is coated with dots of emulsion that increase in diameter with distance away from a remainder of said ink permeable area.

7. A method according to claim 1 wherein the step of locating the screen over the substrate involves locating the screen over the substrate so that the ink permeable area extends beyond the edge of the hole in the substrate.

8. A method according to claim 1 wherein the step of locating the screen over the substrate involves locating the screen over the substrate so that the first part of the ink permeable area extends beyond said edge of the hole in the substrate and the second part of the ink permeable areas is spaced from said edge of the hole in the substrate.

9. A screen in combination wit a hard non-absorbent substrate for printing on to the hard non-absorbent substrate, the screen comprising at least one ink permeable area which is permeable to ink, the ink permeable area having a first and second part, the screen being configured so that a portion of the ink permeable area extends beyond an edge of a hole in the substrate when the screen is located over the substrate during printing, the first part of said ink permeable area in the screen having a reduced ink carrying capacity relative to a second part of the ink permeable area, with the first part of said ink permeable area being adapted to contact the region of the substrate adjacent said edge of the pole in the substrate during printing.

10. A screen in combination with a hard non-absorbent substrate according to claim 9 wherein the ink carrying capacity varies across the first part.

11. A screen in combination with a hard non-absorbent substrate according to claim 10 wherein the ink carrying capacity of the first part decreases with distance away from a remainder of said ink permeable area.

12. A screen in combination with a hard non-absorbent substrate according to claim 9 wherein the first part of the screen is coated with an emulsion, the extent of the emulsion coated on the screen determining the ink carrying capacity of the first part of the screen.

13. A screen in combination with a hard non-absorbent substrate according to claim 12 wherein the first part of the screen is coated with dots of emulsion.

14. A screen in combination with a hard non-absorbent substrate according to claim 13 wherein the dots increase in diameter with distance away from a remainder of the ink permeable area of the screen.

15. A screen in combination with a hard non-absorbent substrate according to claim 12 wherein the ink carrying capacity of the first part is further determined by screen mesh type and/or ink type.

16. A screen in combination with a hard non-absorbent substrate according to claim 8 wherein the screen includes an ink impermeable area that is impermeable to ink, and said second part of said ink permeable area being located between said ink impermeable area and said first part of said ink permeable area.

* * * * *